US008881320B2

(12) United States Patent
Vargas

(10) Patent No.: US 8,881,320 B2
(45) Date of Patent: Nov. 11, 2014

(54) TOILET VALVE LEVER INTERLOCK

(75) Inventor: Matt Vargas, San Jose, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 193 days.

(21) Appl. No.: 13/449,861

(22) Filed: Apr. 18, 2012

(65) Prior Publication Data

US 2012/0260413 A1 Oct. 18, 2012

Related U.S. Application Data

(60) Provisional application No. 61/476,656, filed on Apr. 18, 2011.

(51) Int. Cl.
*E03D 1/14* (2006.01)

(52) U.S. Cl.
USPC ..... 4/326

(58) Field of Classification Search
USPC ..... 4/324–327
See application file for complete search history.

(56) References Cited

U.S. PATENT DOCUMENTS 7,975,324 B2 * 7/2011 Ge et al. ..... 4/326
7,996,927 B2 * 8/2011 Mahler ..... 4/325

* cited by examiner

*Primary Examiner* — Huyen Le
(74) *Attorney, Agent, or Firm* — Gordon Rees Scully & Mansukhani, LLP

(57) ABSTRACT

A dual flush toilet assembly including a locking mechanism that prevents over travel of a piston, thereby preventing inadvertent full flushing when only a partial flush has been selected, yet permits full flushing when so desired. Specifically, a rotatable locking mechanism that prevents the piston from moving fully upwards into the second latched position when a partial flush is desired, yet rotates to an unlocked position to permit the piston to move fully upwards into the second latched position when full flushing is desired.

10 Claims, 4 Drawing Sheets

TOILET VALVE LEVER INTERLOCK

RELATED APPLICATION

The present application claims priority to U.S. Provisional Patent Application 61/476,656, filed Apr. 18, 2011, of the same title, incorporated herein by reference in its entirety.

BACKGROUND OF THE INVENTION

When using a flush valve in a toilet that has multiple lever or button options, it is possible to achieve an undesired flush, depending on user activation. An example is a dual flush toilet where there are two flush states: a partial flush and a full flush. The dual flush toilet valve can use a single cable mechanism assembly to control both flushes. The cable mechanism is controlled by displacing the cable different distances depending on partial vs. full flush. The cable then acts on a mechanism such as a lever assembly which raises a piston member, initiating a flush. The piston interfaces to different latch points for the different flush options. If the piston latches in the incorrect position, the wrong flush will be actuated. If the user activates the cable mechanism assembly quickly, it is possible for the inertia of the piston to cause it to travel past the intended latch point, into the region for the other flush latch position. Specifically, if a user is selecting a partial flush (in which the piston is only supposed to be raised to a first latch point), yet uses too much force too quickly, the piston can inadvertently travel fully upwards to the second latch position causing a full flush. What is instead desired is a system to avoid an inadvertent full flush when only a partial flush has been selected.

SUMMARY OF THE INVENTION

The present invention provides a system for preventing over travel of a piston in a dual flush toilet valve to avoid an inadvertent full flush when only a partial flush has been selected. Specifically, the present invention automatically disables full piston travel (i.e.: a full flush) with an interlock feature unless such full piston travel is desired. This ensures more repeatable flushing as intended by the user.

In preferred aspects, the interlock is a movable lock that prevents over travel for a short distance actuation, and is disabled for full travel distance actuation. The cable mechanism activates a lever that lifts the piston up. In the case of the shorter distance flush (i.e.: the partial flush), the piston has a feature that collides with the lever interlock. This prevents further travel of the piston. In the case of the full distance (full flush), the lever begins the piston in motion. The additional rotation of the piston lever then lifts the interlock lever out of the way of the piston. This allows the piston to travel further upwards.

DETAILED DESCRIPTION OF THE DRAWINGS

Figure 1:
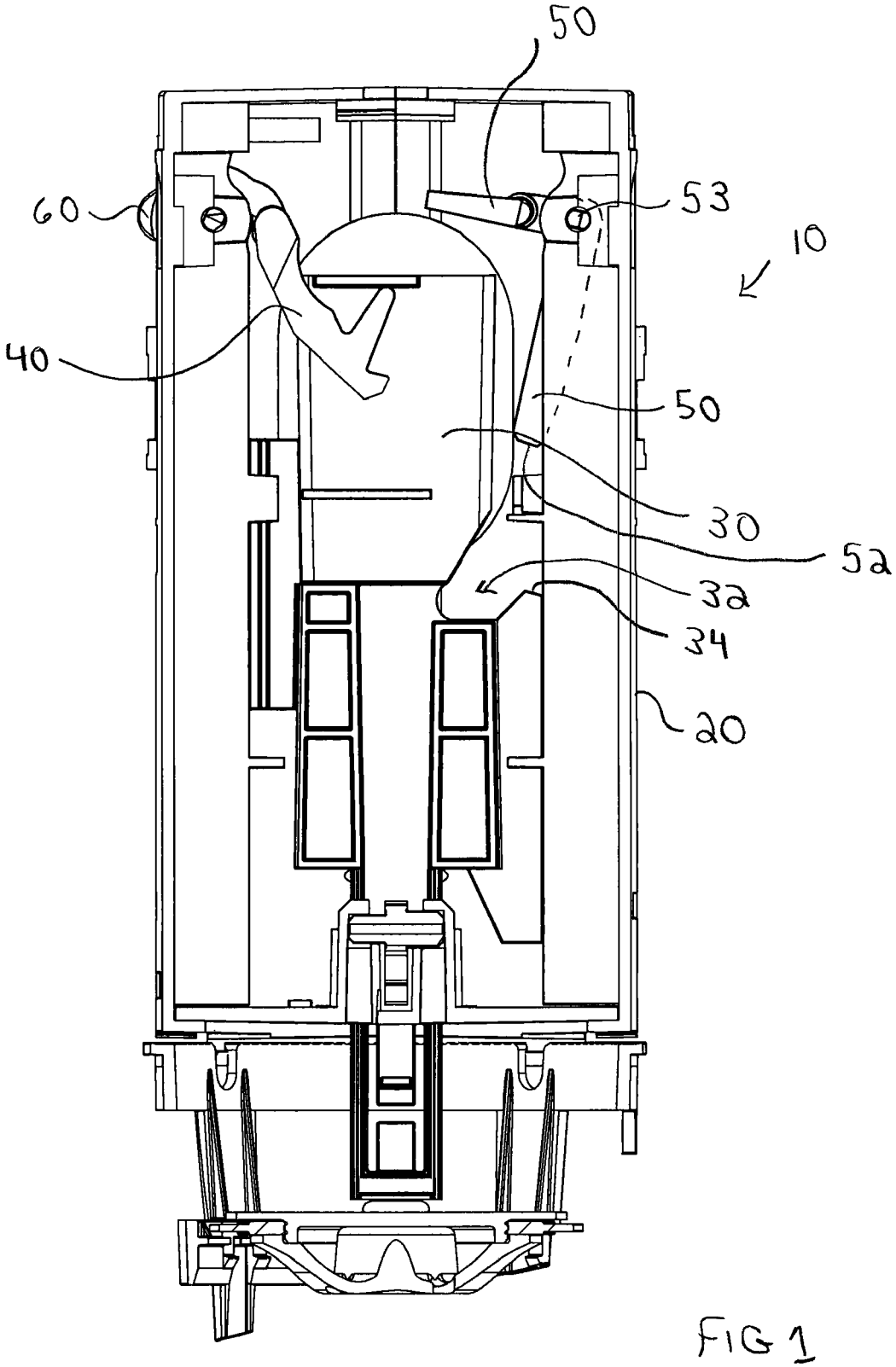
FIG. 1 is an illustration of the flush valve prior to flushing.

FIG. 1 is an illustration of the flush valve prior to flushing showing the components of the present invention, as follows.

A dual flush toilet assembly 10 is provided. Assembly 10 comprises: a frame 20; a piston 30 moveable up and down within frame 20; and a lever 40 mounted to frame 20 for lifting piston 30. As will be shown and explained in FIGS. 1 to 4, lever 40 lifts piston 30 partially upwards to a first latched position for a partial flush and fully upwards to a second latched position for a full flush. Assembly 10 also comprises a locking mechanism 50 mounted to frame 20. As will be shown, this locking mechanism 50 is moveable between a locked position (FIGS. 1, 2 and 3) that prevents piston 30 from moving fully upwards into the second latched position, and an unlocked position (FIG. 4) that permits piston 30 to move fully upwards into the second latched position. In accordance with the present invention, lever 40 moves locking mechanism 50 into the unlocked position when lever 40 lifts piston 30 into the second latched position. Note: the first latched position is the partial flush position and the second latched position is the full flush position. In other words, piston 30 is lifted a shorter distance upwards for a partial flush and a greater distance upwards for a full flush. Also included is an actuator 60 for pulling lever 40 thereby moving the piston upwards to either of the first or second latched positions. Actuator 60 may optionally comprise a flush handle connected to a cable connected to lever 40. Lever 40 rotates about its central pivot point 43.

Figure 2:
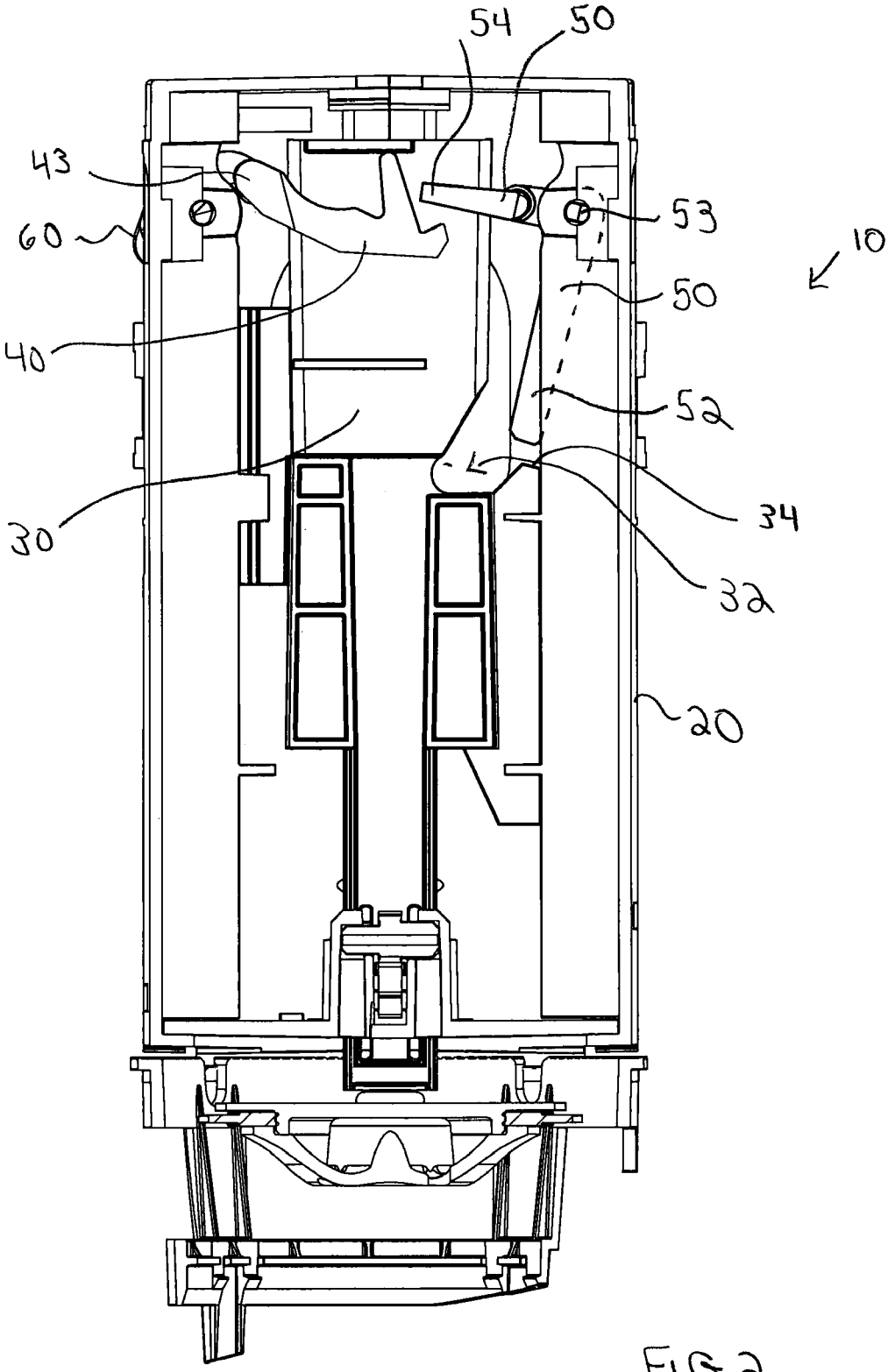
FIG. 2 is an illustration of the flush valve during a partial flush when the piston is moved up to the first latched position.
Figure 3:
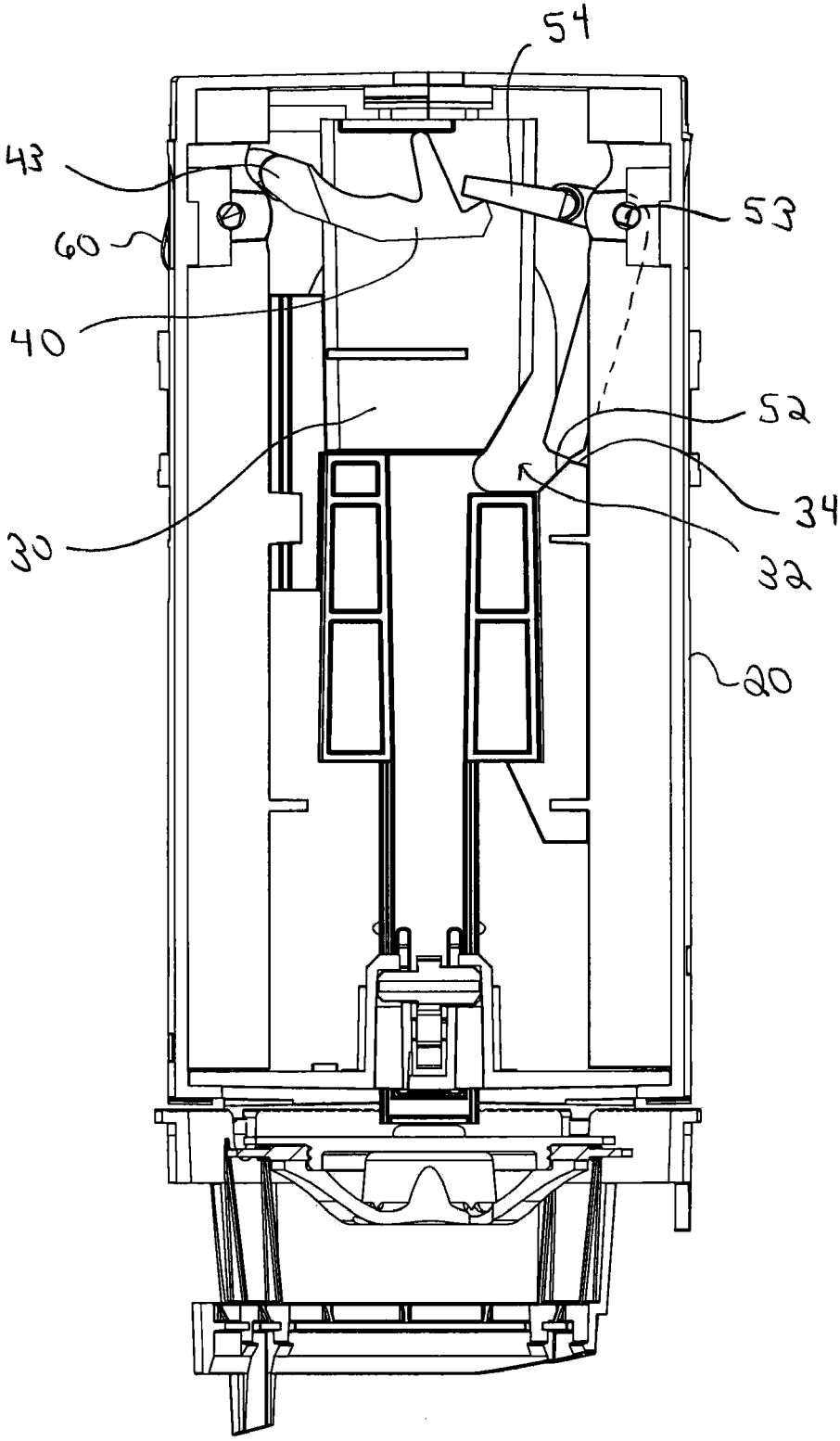
FIG. 3 is an illustration of a full flush when the lever has first contacted the locking mechanism.

As can also be seen, piston 30 has a side recess 32 into which bottom end 52 of locking mechanism 50 can be received. As seen in FIG. 2, a user selects a partial flush (by turning handle which pulls on a cable thereby rotating locking lever 40). This moves lever 40 which in turn pulls piston 30 up to its first latched position. However, if the user inadvertently uses too much force or flushes too quickly, the danger is that piston 30 would "over travel" due to its own inertia, and rise to a position higher than the desired first latched position shown in FIG. 2. The present invention is specifically designed to overcome this problem. As can be seen in FIG. 3, the present system prevents excessive piston movement since side projection 34 on piston 30 will be stopped in its tracks when it hits bottom end 52 of locking mechanism 50. Thus, piston 30 will be prevented from "over travelling" upwards to the second latch position.

Figure 4:
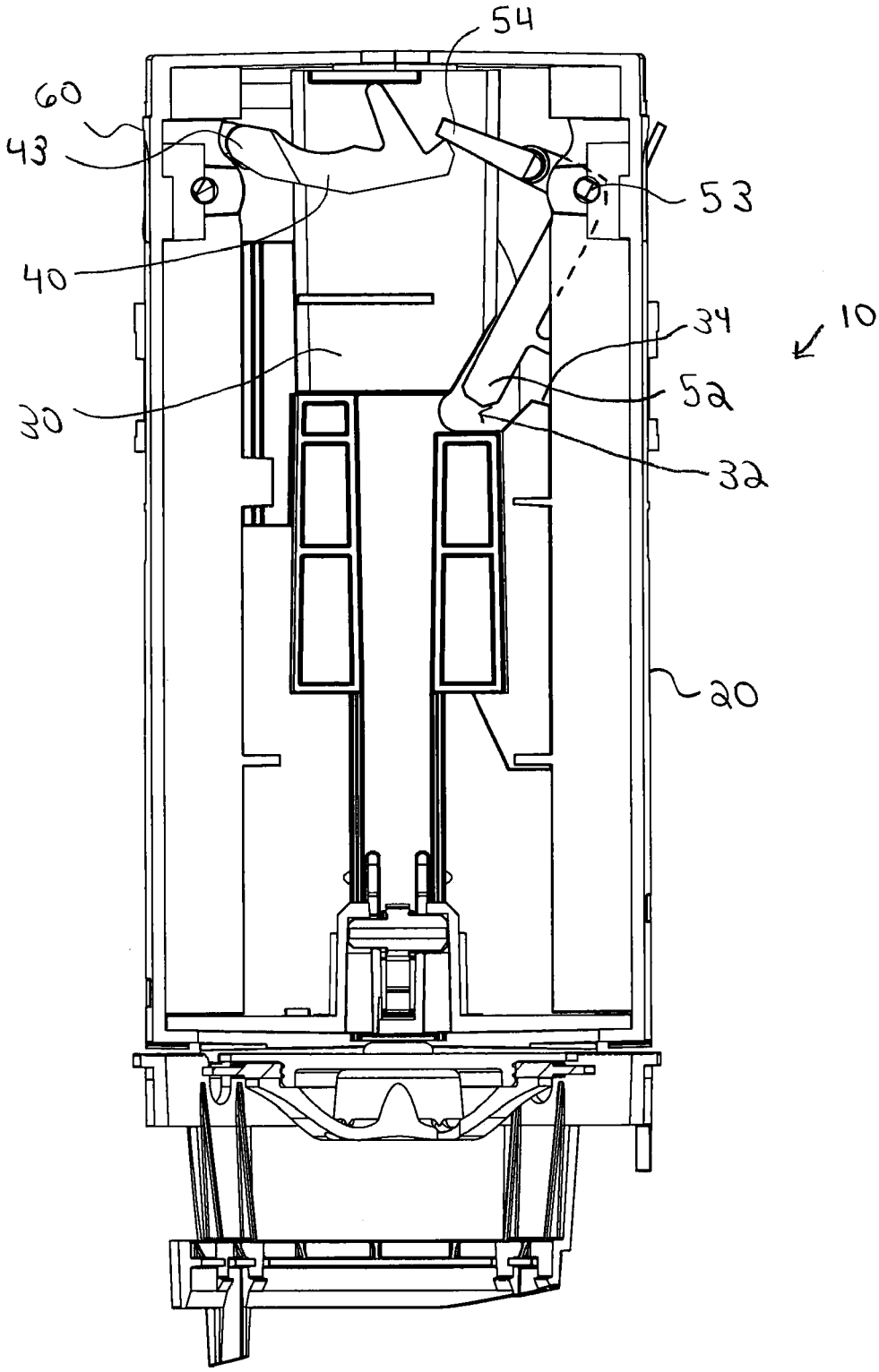
FIG. 4 is an illustration of a full flush after the lever has rotated the locking mechanism such that the piston is cleared to move into in the second latched position.

In accordance with the present invention, however, full flushing is provided when desired as follows. As seen in FIG. 4, when a full flush has been selected (by rotating lever 40 further upwards), lever 40 now contacts the top end 54 of locking mechanism 50, thereby rotating V-shaped locking mechanism 50 about its central pivot point 53. (Note: a hidden portion of locking mechanism 50 is shown in dotted lines for ease of understanding). This is turn rotates bottom end 52 of locking mechanism 50 into recess 32 on piston 30. In summary, piston 30 is thus only free to travel to the second latched position (i.e.: the full flush position shown in FIG. 4), when lever 40 has already caused locking mechanism 50 to release piston 30 for such travel. As a result, full flushing can only be selected when the user has first rotated lever 40 to a position at which it has first released interlock 50.

What is claimed is:

1. A dual flush toilet assembly, comprising:

a frame;

a piston moveable up and down within the frame;

a lever mounted to the frame for lifting the piston, wherein the lever lifts the piston partially upwards to a first latched position for a partial flush and fully upwards to a second latched position for a full flush; and a locking mechanism mounted to the frame, the locking mechanism being moveable between a locked position that prevents the piston from moving fully upwards into the second latched position, and an unlocked position that permits the piston to move fully upwards into the second latched position, wherein the lever moves the locking mechanism into the unlocked position when the lever lifts the piston into the second latched position.

2. The assembly of claim 1, further comprising:

an actuator for pulling the lever thereby moving the piston upwards to either of the first or second latched positions.

3. The assembly of claim 2, wherein the actuator comprises a flush handle connected to a cable connected to the lever.

4. The assembly of claim 1, wherein the piston has a recess into which one end of the locking mechanism is received.

5. The assembly of claim 4, wherein the recess is on the side of the piston.

6. The assembly of claim 4, wherein lifting the lever moves one end of the locking mechanism into the recess on the piston.

7. The assembly of claim 6, wherein lifting the lever causes an end of the lever to contact and lift an upper portion of the locking mechanism, thereby rotating the locking mechanism such that a lower portion of the locking mechanism moves into the recess on the side of the piston.

8. The assembly of claim 1, wherein a free end of the lever is received under a protrusion on the piston.

9. The assembly of claim 1, further comprising:

a track along which the piston moves.

10. The assembly of claim 1, wherein the locking mechanism is V-shaped and rotates around the apex of the V, wherein the lever contacts and lifts one end of the locking mechanism, thereby rotating the other end of the locking mechanism into the recess in the side of the piston.

* * * * *